US005230584A

United States Patent [19]

Grossman

[11] Patent Number: 5,230,584

[45] Date of Patent: Jul. 27, 1993

[54] PAVING BLOCK STRUCTURES

[75] Inventor: Norman W. Grossman, East Brunswick, N.J.

[73] Assignee: Capitol Ornamental Concrete Specialities, Inc., South Amboy, N.J.

[21] Appl. No.: 746,951

[22] Filed: Aug. 16, 1991

[51] Int. Cl.[5] ..... E01C 5/00

[52] U.S. Cl. ..... 404/41; 404/42

[58] Field of Search ..... 404/42, 41; 52/311

[56] References Cited

U.S. PATENT DOCUMENTS 5,046,887 9/1991 Fontana et al. ..... 404/41 X

FOREIGN PATENT DOCUMENTS 2609234 3/1976 Fed. Rep. of Germany ..... 404/42

3303210 8/1984 Fed. Rep. of Germany ..... 404/42

*Primary Examiner*—William P. Neuder

*Attorney, Agent, or Firm*—Lerner, David, Littenberg, Krumholz & Mentlik

[57] ABSTRACT

Two forms of paving block are disclosed each having a hexagonal body portion capable of being divided along a central score line into two mirror image portions and one of the forms of block further containing a square stem portion also separable from its associated body portion along a further score line. A ground covering structure is formed by laying the blocks laterally side by side to form a substantially continuous paving employing both forms of blocks and selectively breaking the hexagonal portion of such blocks and fitting the severed mirror image portions into voids whereby the perimeter of the structure can be defined by straight lines without further breaking or cutting of any of the block forms.

20 Claims, 5 Drawing Sheets

PAVING BLOCK STRUCTURES

BACKGROUND OF THE INVENTION

1. Field of the Invention

This invention relates to paving blocks made of concrete, cement, sand or stone for covering the ground. Such ground covering blocks are used in the construction of traffic carrying surfaces such as vehicular traffic or pedestrian traffic, for example, walkways, squares, foot paths, entrance drives and the like.

2. Description of the Prior Art

Prior art paving blocks of shapes other than square or rectangular do not permit the creation of ground covering structures with straight perimeter edges except with the requirement that paving blocks be cut or that there be a great number of shapes of blocks to meet all desired structure configurations. The use of a number of block shapes increases costs and the requirement that certain blocks be cut wastes blocks and materials.

One such prior art paving block structure is shown in U.S. Pat. No. B1 4,128,357 originally issued Dec. 5, 1978 and having a re-examination certificate date of Jul. 17, 1984. The slab element shown, described and claimed has a hexagonal plan profile body and a square plan profile stem attached to one of its eight perimeter segments with a score line extending through the center of both the hexagonal body and square stem. A ground covering made of these blocks cannot produce a straight perimeter edge employing only the basic slap element with or without the stem attached and only separating selective slab elements along its score lines. A straight edged ground cover can only be produced using a number of different block configurations or breaking the blocks at locations other than the preformed score lines. This increases the number of block shapes that must be carried in inventory or requires that the slab elements be broken on site which is highly wasteful of the block material and worker time.

SUMMARY OF THE INVENTION

The problems noted above are overcome by the use of paving blocks of the instant invention which have selectively severable portions which can be removed and repositioned with respect to other blocks of the structure to form straight perimeter edges without wasting any of the blocks.

These desired results are achieved by providing two block forms each having a body portion having first and second opposed faces and a hexagonal plan profile defined by six segments and six vertices and a groove extending between an opposed pair of said vertices in at least one of said faces to define in said body two mirror image portions which can be separated along such groove. One of the block forms further includes a stem portion having first and second opposed faces co-planar with said body portion first and second faces respectively and a square plan profile defined by four sides with one side joined to a body portion segment parallel with said groove. A further groove along the juncture between said body portion and stem portion in at least one of said faces permits the stem portion to be selectively separated from the body portion.

Once the ground covering structure is built up using both forms of blocks, the blocks at the perimeter of the structure can be broken along the groove and the severed mirror portion reunited and fitted into correspondingly shaped voids to provide a perimeter with a straight edge.

It is an object of this invention to provide an improved paving block configuration selectively scored so that portions thereof can be selectively severed and removed.

It is a further object of this invention to provide two paving block configurations which can be employed to provide a ground covering structure.

It is still another object of this invention to provide two paving block configurations scored so that portions of such blocks can be severed, removed and repositioned to permit the creation of a ground covering structure with a straight perimeter.

Other objects and features of the invention will be pointed out in the following description and claims and illustrated in the accompanying drawings, which disclose, by way of example, the principles of the invention, and the best mode which has been contemplated for carrying them out.

BRIEF DESCRIPTION OF THE DRAWINGS

In the drawings in which similar elements are given similar reference characters.

DESCRIPTION OF THE PREFERRED EMBODIMENT

Figure 1:
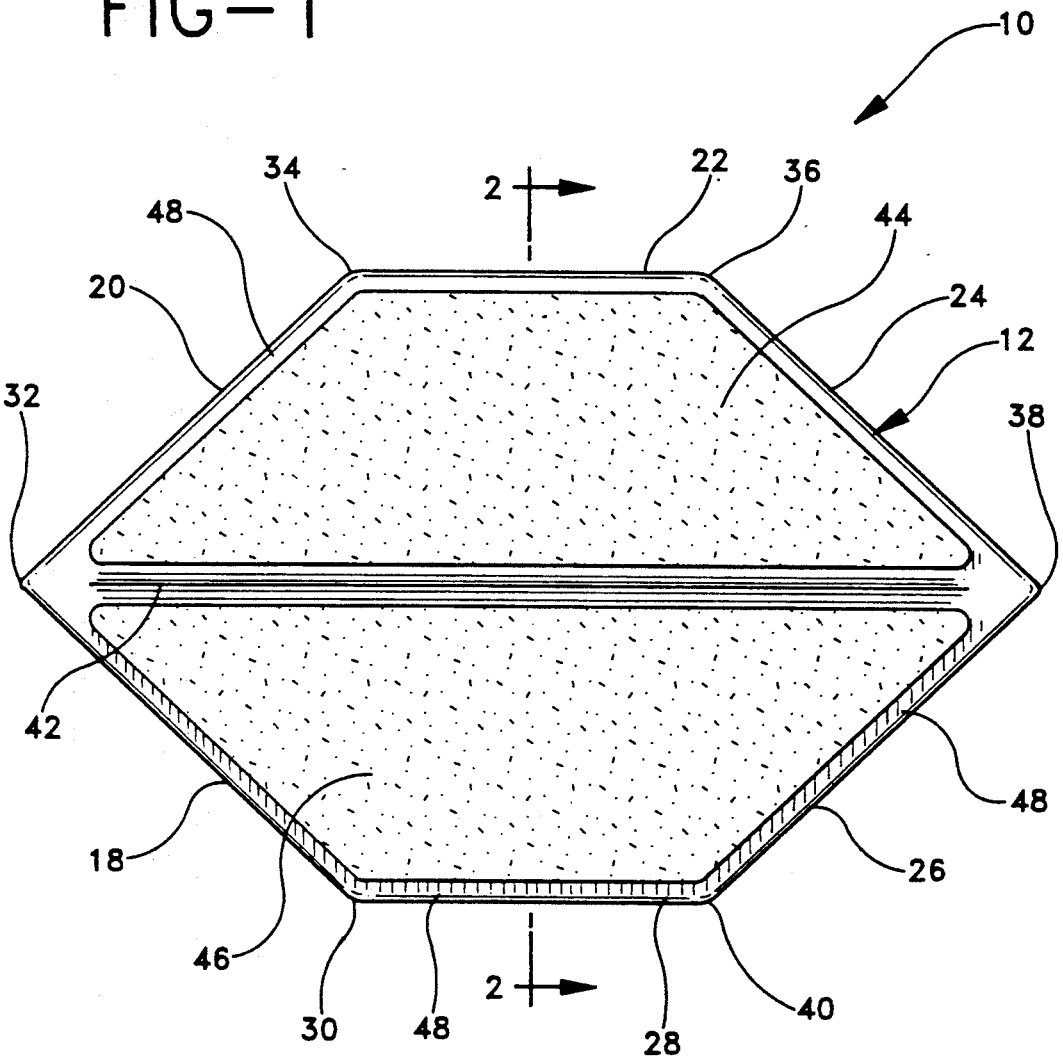
FIG. 1 is a top plan view of a first configuration of paving block constructed in accordance with the concepts of the invention.
Figure 2:
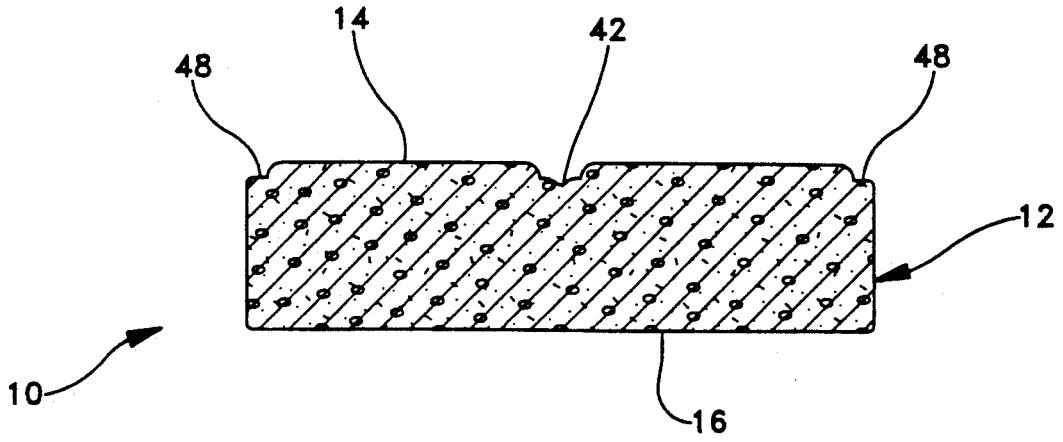
FIG. 2 is a side elevational view of the paving block, in section, taken along the line 2—2 in FIG. 1.
Figure 3:
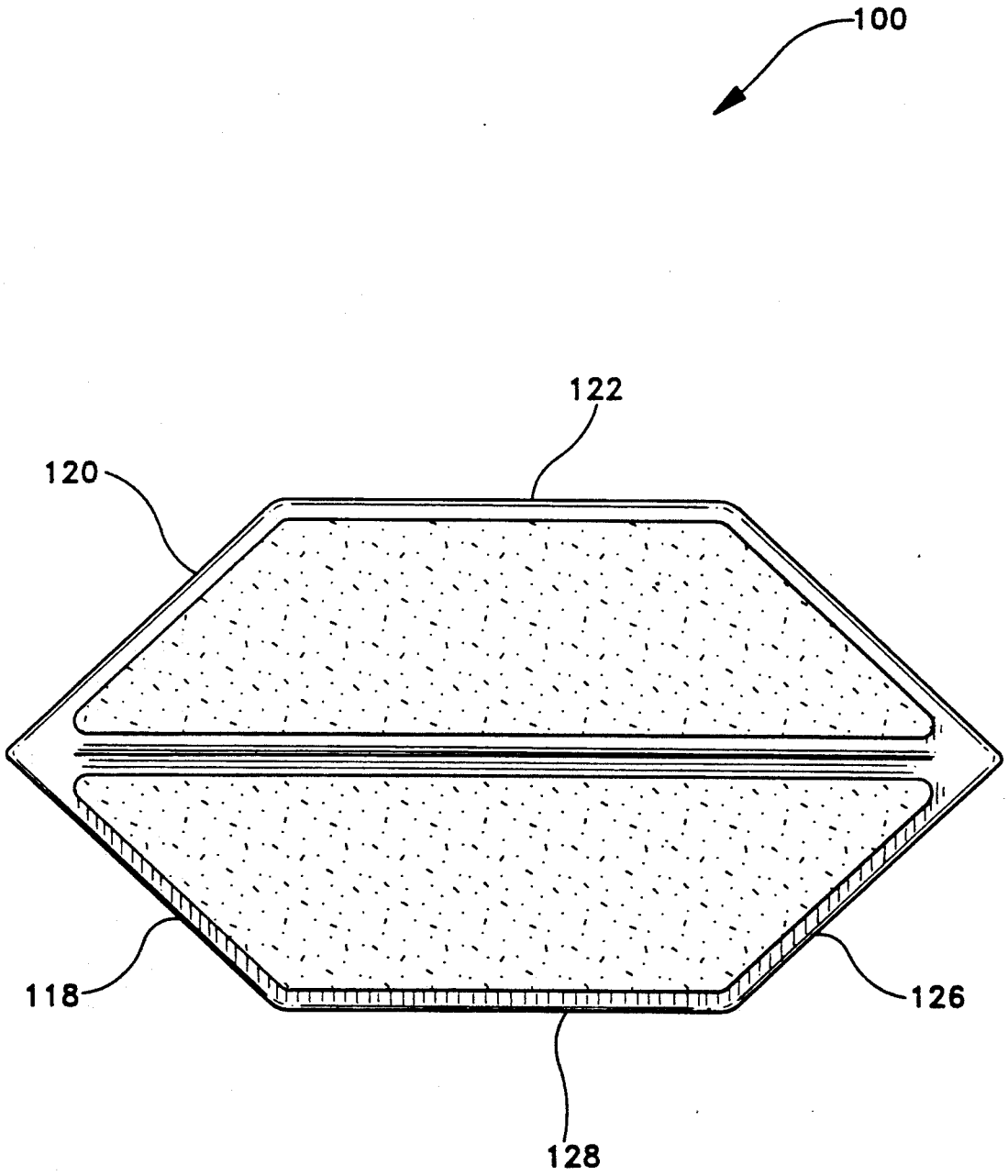
FIG. 3 is a top plan view of an alternative configuration of the paving block of FIG. 1 constructed in accordance with the concepts of the invention.

Turning now to FIGS. 1 and 2, there is shown a first form of paving block 10 constructed in accordance with the concepts of the invention. Paving block 10 has a body portion 12 having a top face 14 and a bottom face 16 and a hexagonal plan profile defined by six segments or edges 18, 20, 22, 24, 26 and 28, respectively. Segments 18, 20, 24 and 26 are of the same length and longer than segments 22 and 28 which are of the same length. Alternatively, as is shown in FIG. 3, paving block 100 has segments 118, 120, 124 and 126 of the same length and shorter than segments 122 and 128 which are of the same length.

Returning to FIGS. 1 and 2, paving block 10 is further defined by six vertices 30, 32, 34, 36, 38 and 40, respectively. The opposed vertices 32 and 38 each form right angles, whereas the vertices 30, 34, 36 and 40, respectively, are of 135° each. A groove or score line 42 extends in face 14 along the line between opposed vertices 32 and 38 permitting body portion 12 to be broken into two mirror image portions 44 and 46. If desired, a similar score line can be placed in face 16 to make the breaking of thick blocks or stone block easier. The paving block 10 can be easily broken by supporting and elevating the block 10 along either of the segments 22 and 28 (not shown) and striking with a hammer or by the use of a hammer and chisel, tapping the chisel with the hammer along the groove or score line 42.

In a typical paving block 10, the segments 18, 20, 24 and 26 will each be approximately 95 millimeters in length, the segments 22 and 28 will each be approximately 67 millimeters, while the length between the opposed vertices 32 and 38 will be approximately 200 millimeters. The block is of a thickness of approximately 60 millimeters, and may be fabricated from concrete, stone or sand in a proper binder as is well-known in the art with a minimum strength of 8,000 psi. Of course, depending upon the particular application for the paving blocks, they can be fabricated to have a size and strength which is either greater than or less than these typical values.

The face 14 is tapered as at 48 to give a finished appearance to the block 10 and avoid ragged top face 14 edges.

Figure 4:
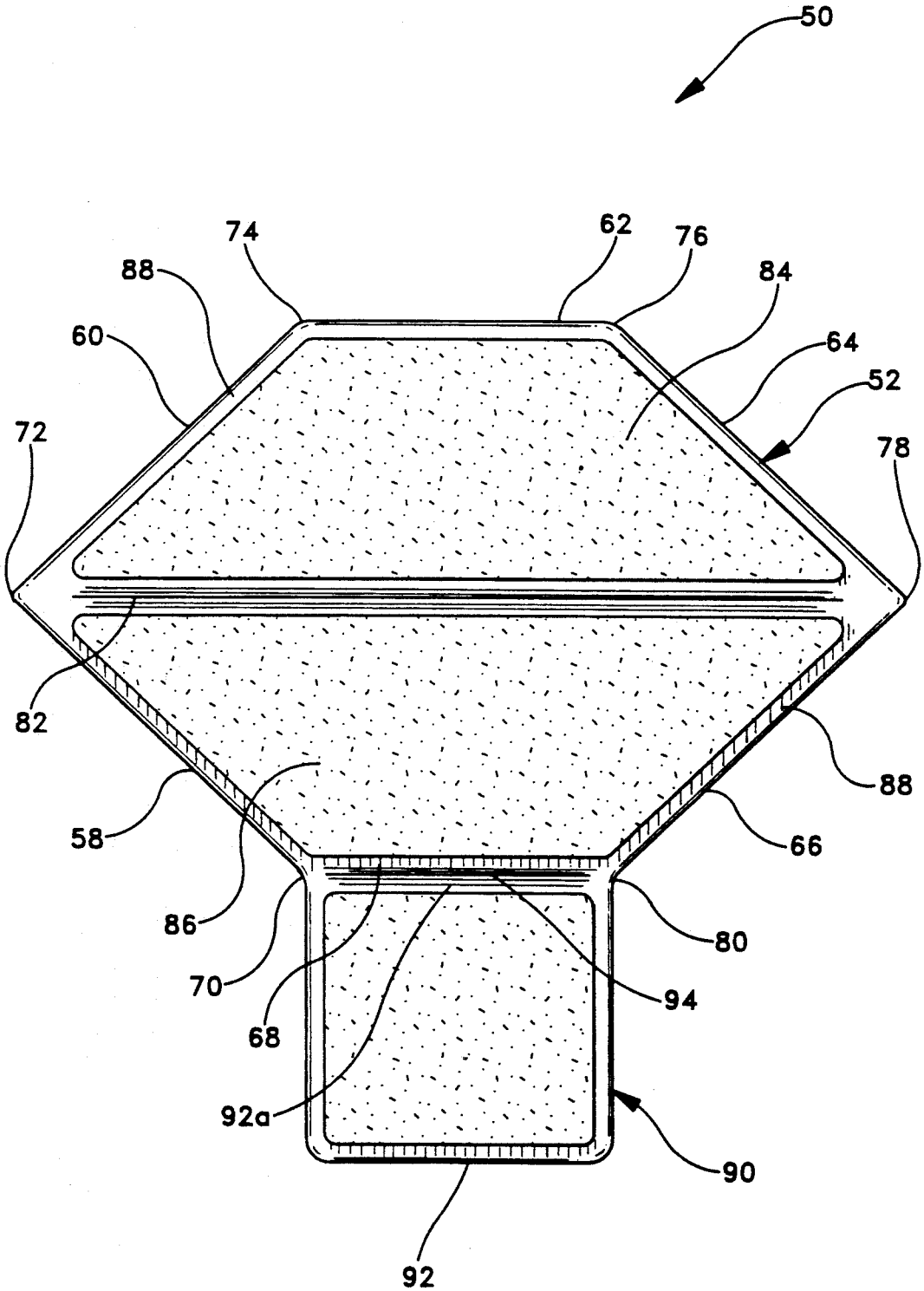
FIG. 4 is a top plan view of the second form of paving block constructed in accordance with the concepts of the invention.

Turning now to FIG. 4, there is shown a second form of paving block 50 constructed in accordance with the concepts of the invention. Paving block 50 has a body portion 52 defined by parallel opposed flat faces and a hexagonal configuration defined by segments 58, 60, 62, 64, 66 and 68, respectively, and vertices 70, 72, 74, 76, 78 and 80, respectively. A first score line 82 extends between vertices 72 and 78, respectively, to permit body portion 52 to be separated into two mirror image portions 84 and 86, respectively. The top face is tapered as at 88.

Paving block 50 further comprises a stem portion 90 having top and bottom faces coextensive with the top and bottom faces of body portion 52 and having a square plan profile defined by sides 92. One side 92*a* is joined to segment 68 along a second groove or score line 94 which permits stem portion 90 to be separated from body portion 52.

Figure 5:
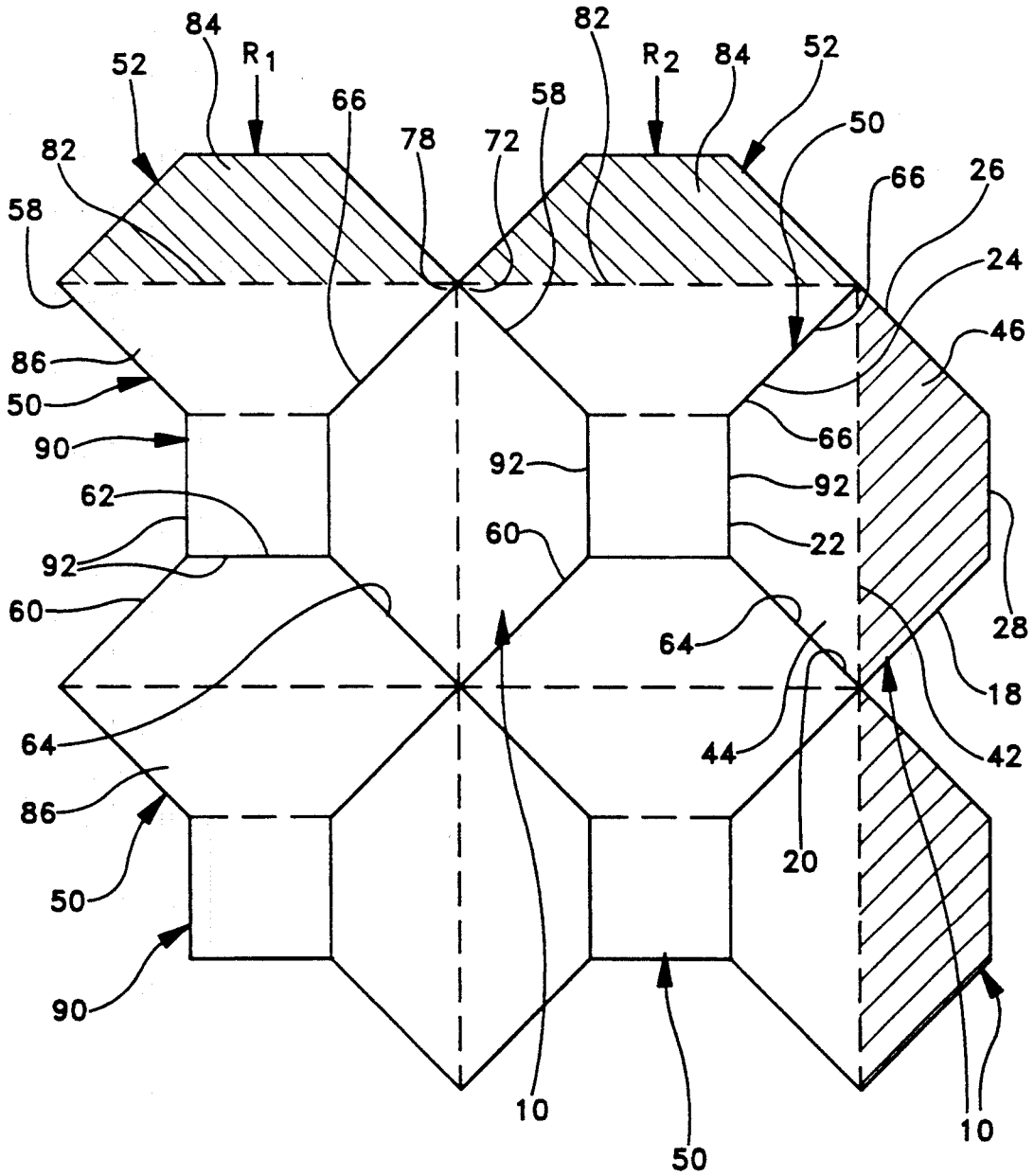
FIG. 5 is a top plan view of a ground covering structure formed of paving blocks according to FIGS. 1 and 4.
Figure 6:
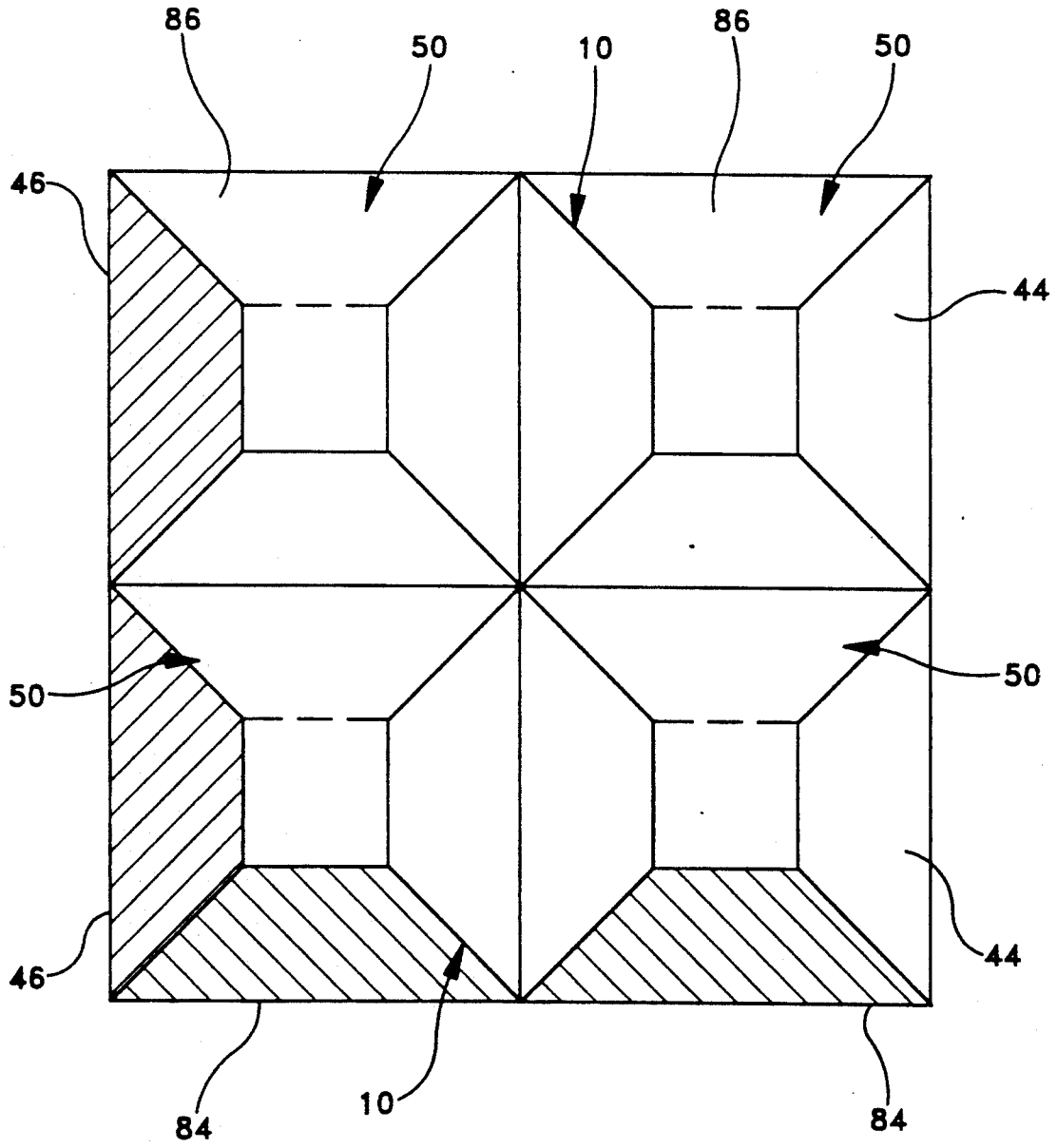
FIG. 6 is a top plan view of the ground covering structure of FIG. 5 in its completed form with straight perimeter edges.

To create a ground covering structure 200 as is shown in FIGS. 5 and 6, paving blocks 10 and 50 are laid laterally side by side on a prepared surface (not shown) which may be level soil, sand, crushed stone, or the like. Two rows of paving blocks 50 are laid with side 92 of one stem portion 90 of block 50 in contact with segment 62 of the next consecutive block 50 in the row. The rows are arranged such that the opposed vertices 72 and 78 are in alignment and contact. Thus, vertices 78 of paving blocks 50 of row $R_1$ are in alignment and contact with vertices 72 of paving blocks 50 in row $R_2$.

The void between two consecutive junctures of the opposed vertices defined by segment 66 and side 92 of the first paving block 50 of row $R_1$ and segment 64 of the second paving block of row $R_1$, segment 58 and side 92 of the first paving block 50 of row $R_2$ and segment 60 of the second paving block 50 of row $R_2$ is filled by paving block 10. In a similar fashion, each of the spaces enclosed within paving blocks 50 may be filled with a paving block 10.

The non-enclosed spaces created by blocks 50 along their marginal edges may be filled as follows: a paving block 10 is set so that its segments 20, 22 and 24, respectively, are in contact with segment 66 and side 92 of the first paving block 50 of row $R_2$ and segment 64 of the second paving block 50 in row $R_2$, respectively. Paving block 10 may now be broken into two mirror image portions by breaking along groove or score line 42 and removing mirror image portion 46 to provide a straight marginal edge to the structure.

The severed mirror image portion 46 may now be laterally shifted and placed so that segments 26, 28 and 18, respectively, are brought into contact with segment 58 and side 92 of the first paving block 50 in row $R_1$ and segment 60 of the second paving block 50 in row $R_1$ to provide a straight marginal edge on the left side of row $R_1$. In a similar manner, body portions 52 of the first paving blocks 50 in rows $R_1$ and $R_2$ may be split along grooves or score lines 82 to separate mirror image portions 84 and permit their downward shift to fill the voids along the trailing edge of the structure.

In FIG. 5, each of the body portions that are to be severed are shown with cross-hatching. Once severed and moved, the completed structure is shown in FIG. 6. The cross-hatching is retained to clearly indicate the final positions of the severed mirror image portions.

It can be clearly seen from comparison of FIGS. 5 and 6 that there is no wasted block portions and that a structure can be achieved that has all straight line edges and requiring only two paving block configurations where individual blocks can be broken along predetermined grooves or score lines to provide all required components making the formation of a ground covering structure relatively simple and quick.

While there have been shown and described and pointed out the fundamental novel features of the invention as applied to the preferred embodiments, it will be understood that various omissions and substitutions and changes of the form and details of the devices illustrated and in their operation may be made by those skilled in the art, without departing from the spirit of the invention.

I claim:

1. A paving block comprising:

a body having first and second opposed faces and a hexagonal plan profile defined by six segments and six vertices; and a groove extending between an opposed pair of said vertices in at least one of said faces to define in said body two mirror image portions, whereby said groove defines a weakened area for breaking said body into said two mirror image portions, each of which can be employed separately and wholly to provide a continuous straight marginal edge for a ground cover constructed from said paving blocks.

2. A paving block as claimed in claim 1, wherein each pair of said opposed pair of vertices forms a 90° angle.

3. A paving block as claimed in claim 1, wherein two of said segments extend parallel to said groove, each of said two segments having a length which is longer than the length of each of the remaining segments.

4. A paving block as claimed in claim 1, wherein two of said segments extend parallel to said groove, each of said two segments having a length which is shorter than the lengths of each of the remaining segments.

5. A paving block as claimed in claim 2, wherein two of said segments extend parallel to said groove and wherein said body further comprises a stem portion having a square plan profile defined by four sides, one side of said stem portion extending between two adjacent ones of said vertices disposed between said opposed pair of vertices.

6. A paving block as claimed in claim 5, further comprising a second groove formed in at least one of said faces along said one side of said stem portion, whereby said second groove defines a weakened area for breaking said stem portion from said body and permitting separation of said stem portion from said body.

7. A ground covering comprising a plurality of paving blocks each comprising:

a body having first and second opposed faces and a hexagonal plan profile defined by six segments and six vertices; and a groove extending between an opposed pair of said vertices in at least one of said faces to define in said body two mirror image portions, whereby said groove defines a weakened area for breaking said body into said two mirror image portions, each of which can be employed separately and wholly to provide a continuous straight marginal edge for said ground cover constructed from said paving blocks.

8. A ground covering as claimed in claim 7, wherein two of said segments extend parallel to said groove, each of said two segments having a length which is longer than the length of each of the remaining segments.

9. A ground covering as claimed in claim 7, wherein two of said segments extend parallel to said groove, each of said two segments having a length which is shorter than the lengths of each of the remaining segments.

10. A ground covering as claimed in claim 7, wherein each pair of said opposed pair of vertices forms a 90° angle.

11. A ground covering as claimed in claim 10, wherein two of said segments extend in parallel to said groove, and wherein each of said blocks further comprises a stem portion having a square plan profile, one side of said stem portion extending between two adjacent ones of said vertices disposed between said opposed pair of vertices.

12. A ground covering as claimed in claim 11, wherein each of said paving blocks further comprises a second groove formed in at least one of said faces along said one side of said stem portion whereby said second groove defines a weakened area for breaking said stem portion from said body and permitting separation of said stem portion from said body.

13. A composite ground covering structure comprising paving blocks, said blocks being laid laterally side by side so as to form a substantially continuous paving comprising;

a plurality of parallel rows of paving blocks, each of said blocks comprising a body having first and second opposed faces and a hexagonal plan profile defined by six segments and six vertices;

a first groove extending between an opposed pair of said vertices in at least one of said faces to define in said body two mirror image portions, said first groove defining a weakened area for breaking said body into said two mirror image portions each of which can be employed separately and wholly;

two of said segments extending in parallel with said first groove;

a stem portion having a square plan profile defined by four sides, one side of said stem portion extending between two adjacent ones of said vertices disposed between said opposed pair of vertices;

a second groove formed in at least one of said faces along said one side of said stem portion, said second groove defining a weakened area for breaking said stem portion from said body;

said paving blocks being arranged in each row so that the side of said stem portion of one paving block parallel with said second groove is in contact with the segment of said body parallel with said second groove and remote from said stem portion with the tips of said opposed pairs of vertices in contact with the tips of said opposed pairs of vertices of adjacent rows; and the spaces between consecutive contacts between the tips of adjacent opposed pairs of vertices filled by a paving block body, said first grooves of said blocks describing a continuous straight marginal edge of said rows.

14. A composite ground covering structure as claimed in claim 13, wherein each of the block bodies along the free parallel marginal edges of the ground covering structure are broken along their respective first grooves to provide straight marginal edges.

15. A composite ground covering structure as claimed in claim 13, wherein each of the blocks which lie along one of the free parallel marginal edges of the ground covering structure is broken along their respective first grooves to provide a first straight marginal edge and the severed mirror image portions are moved laterally and placed in the voids along the line of the second marginal edge of said structure to provide a second straight marginal edge.

16. A method of forming a composite substantially continuous ground covering structure of paving blocks, each block comprising a body having first and second opposed faces and a hexagonal plan profile defined by six segments and six vertices, and a first groove extending between an opposed pair of said vertices on at least one of said faces to define in said body two mirror image portions, said first groove defining a weakened area for breaking said body into said two mirror image portions; two of said segments extending in parallel with said first groove; a stem portion having a square plan profile defined by four sides, one side of said stem portion extending between two adjacent ones of said vertices disposed between said opposed pair of vertices; a second groove formed in at least one of said faces along said one side of said stem portion, said second groove defining a weakened area for breaking said stem portion from said body; said method comprising the steps of:

arranging said blocks in at least one row with the side of said stem portion of one paving block parallel with said second groove in contact with the segment of said body parallel with said second groove and remote from said stem portion of the next consecutive block;

severing said two mirror image portions of a block body along said first groove; and placing one of said two mirror image portions against each of the exposed sides of said stem portion to define straight marginal edges for said ground covering structure.

17. The method as claimed in claim 16 further comprising the steps of:

severing said body of the first paving block in the row along said first groove;

removing said severed portion of said body;

moving said severed portion longitudinally; and placing said severed portion in contact with the stem portion of the last paving block in the row whereby the leading and trailing edges of said paving block row in straight.

18. A method of forming a composite substantially continuous ground covering structure of paving blocks, each block comprising a body having first and second opposed faces and a hexagonal plan profile defined by six segments and six vertices, and a first groove extending between an opposed pair of said vertices on at least one of said faces to define in said body a weakened area for breaking said body into said two mirror image portions; two of said segments extend in parallel with said first groove; a stem portion having a square plan profile defined by four sides, one side of said stem portion extending between two adjacent ones of said vertices disposed between said opposed pair of vertices; a second groove formed in at least one of said faces along said one side of said stem portion, said second groove defining a weakened area for breaking said stem portion from said body; said method comprising the steps of:

arranging said blocks in two or more rows with the side of said stem portion of one paving block parallel with said second groove in contact with the segment of said body parallel with said second groove and remote from said stem portion of the next consecutive block with the tips of said opposed pairs of vertices in contact with the tips of said opposed pairs of vertices of adjacent rows;

placing a paving block body in the spaces defined by consecutive contacting tips of opposed pairs of vertices to form a substantially continuous ground covering structure with continuous straight marginal edges.

19. The method as claimed in claim 18, further comprising the steps of:

severing said two mirror image portions of a plurality of block bodies along their respective first grooves; and placing one of said two mirror image portions against each of the exposed sides of said stem portions in the two marginal rows of the structure to define continuous straight marginal edges for said ground covering structure.

20. The method as claimed in claim 19, further comprising the steps of:

serving the bodies of the first paving blocks in each row along said first groove;

removing said severed portion of said block body;

moving said severed portion longitudinally; and placing said severed portion in contact with the last stem portions of the paving block in each of the rows stem portions whereby the leading and trailing edges of said structure are straight.

* * * * *

UNITED STATES PATENT AND TRADEMARK OFFICE

CERTIFICATE OF CORRECTION

PATENT NO. : 5,230,584

DATED : July 27, 1993

INVENTOR(S) : Norman W. Grossman

It is certified that error appears in the above-identified patent and that said Letters Patent is hereby corrected as shown below:

Column 6, line 54, after "straight" insert --continuous--.
Column 6, line 65, "in" should read --are--.
Col. 8, line 16, "serving" should read --severing--

Signed and Sealed this

Twelfth Day of April, 1994

Bruce Lehman

BRUCE LEHMAN

*Commissioner of Patents and Trademarks*

*Attest:*

*Attesting Officer*